United States Patent [19]

Seki

[11] 4,347,980

[45] Sep. 7, 1982

[54] ORNAMENTAL SPRAYING APPARATUS AND A SPRAYER THEREFOR

[75] Inventor: Michinori Seki, Ibaragi, Japan

[73] Assignee: Tokushu Aerosol Co. Ltd., Tokyo, Japan

[21] Appl. No.: 173,558

[22] Filed: Jul. 30, 1980

[30] Foreign Application Priority Data

Mar. 25, 1980 [JP] Japan ..... 55/038254[U]

[51] Int. Cl.[3] ..... B05B 15/00

[52] U.S. Cl. ..... 239/289; 239/331; 222/402.15

[58] Field of Search ..... 239/211, 289, 329, 331, 239/333; 222/78, 321, 385, 402.15; D. 27/36

[56] References Cited

U.S. PATENT DOCUMENTS

D. 208,810 10/1967 Dexter ..... D. 27/36
1,947,353 2/1934 Mueller ..... 239/211
4,061,250 12/1976 Tada ..... 222/321
4,077,549 3/1978 Beard ..... 222/321
4,087,025 5/1978 Steinman ..... 222/321

FOREIGN PATENT DOCUMENTS 648460 1/1951 United Kingdom ..... 239/333

*Primary Examiner*—Robert B. Reeves
*Assistant Examiner*—Paul A. Sobel
*Attorney, Agent, or Firm*—Peter D. Galloway

[57] ABSTRACT

An ornamental spraying apparatus comprising in combination a sprayer having an upward nozzle and an opening at the bottom through which the content can be refilled; a cylindrical container for accommodating said sprayer with an open bottom; an ornamental article supporter means to be mounted at the top of said sprayer to a part of which a lever means to actuate the sprayer is pivotably secured is disclosed.

19 Claims, 3 Drawing Figures

ORNAMENTAL SPRAYING APPARATUS AND A SPRAYER THEREFOR

TECHNICAL FIELD OF THE INVENTION

This invention relates to a novel manually operated sprayer and an ornamental spraying apparatus. More particularly, it relates to an ornamental spraying apparatus comprising a combination of a manually operated sprayer, a container therefor (for instance, a vase-like container) and a holder for ornamental articles such as artificial flowers or dry flowers and a novel sprayer for that purpose.

BACKGROUND OF THE INVENTION

Ornamental vases with artificial flowers or ornamental flower pots with artificial flowers are well-known and age-old. Artificial flowers impregnated with aromatics so as to emit fragrance are also well-known. However, even if the artificial flowers are made of porous materials, the capacity of the material to retain the aromatic material is limited, and they cannot emit fragrance over a long period of time.

Combination of an ornamental article and a pressurized packaging (aerosol) perfume dispenser was proposed. But the design is limited because of the mechanism of the aerosol valve, and the shape of the aerosol container, and use of pressurized packaging products now is not desirable because fluorocarbon propellent gas causes environmental pollution and the cans and valves are discarded, which is waste of valuable resources.

DISCLOSURE OF THE INVENTION

The purpose of this invention is to provide a novel manually operated sprayer having an upwardly directed nozzle, an opening with a lid at the bottom through which refilling of the material to be sprayed is effected, an ornamental article holder means mounted on the top thereof, to a part of which a lever means to actuate said sprayer is pivotably secured.

Secondarily, the purpose of this invention is to provide an ornamental spraying apparatus comprising in combination a sprayer having an upwardly directed nozzle, an opening with a lid at the bottom thereof, through which refilling of the material to be sprayed is effected, and an ornamental article holder means mounted on the top thereof, to a part of which a lever means to actuate said sprayer is pivotably secured, and a container for accommodating said sprayer.

This invention is primarily intended for artificial flowers or dry flowers. But other ornamental articles can be applied to the sprayer and the spraying apparatus of this invention. The sprayer of this invention can be used in combination with a coffee cup, a large-mouth bottle or any other vessels, if they can stably accommodate the sprayer. Now the invention is explained in detail in respect of its preferred embodiments with reference to the attached drawings.

BRIEF DESCRIPTION OF THE ATTACHED DRAWINGS

DETAILED DESCRIPTION OF THE PREFERRED EMBODIMENT

Figure 1:
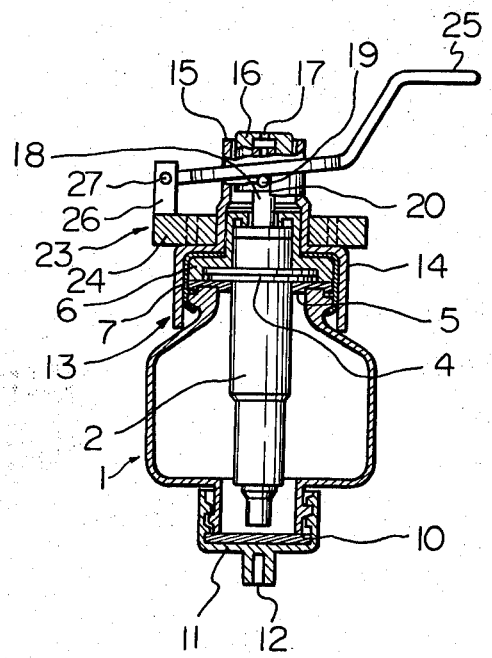
FIG. 1 is an elevational cross-sectional (partly cutout non-cross-sectional) view of a preferred embodiment of the sprayer of this invention.

In FIG. 1, a hand operated sprayer (1) comprises a spray valve or pump (2) and a perfume container (bottle) (3). The former has a flange (4), and the spray valve (2) is secured to the mouth of the perfume container (bottle) (3) by means of said flange (4), a gasket (5), a valve cap (6) and a ferrule (7). That is, the gasket is placed on the top of the mouth of the perfume container, then the spray valve (2) is inserted so that its flange rests on the gasket and then the cap is placed thereon and a ferrule (7) is placed so as to cover all these and is swaged at the underside of the mouth bead of the spray container (bottle). However, this is just one embodiment and other securing measures can be resorted to.

The perfume container (bottle) is of an ordinary cylindrical form except that it has an opening or another mouth at the bottom which is provided with a screwed lid which can be removably secured to the opening by means of the screw with the aid of a gasket (10) sandwiched between the lid and the opening of the bottle. The lid can be provided with a groove (12) which fits the thickness of a coin so that the user can insert the edge of a coin therein and turn the lid therewith to open it.

The spray valve (pump) is the known one that draws up a liquid by the principle of pump and mechanically atomizes the liquid. Employment of the so-called pressure build-up spray valve (non-throttling pump) such as disclosed in September 1975 issue of "Aerosol Age" (p. 36) is most preferred, although not limited thereto.

The top of the hand operated sprayer (1) comprises a hood (13), the lower part of which forms a skirt (14) which is secured to the ferrule (7) over the cap (6) covering them. The upper part of the hood forms a cylindrical part (15) receives an outlet stem (18), which is an operating member of the spray valve (2). A spray head (16), which is provided with a spray nozzle (mechanical break-up nozzle) (17) at the upper end thereof is secured to the outlet stem (18). A pair of pins (19) are provided on the lower part of the spray head one on each side. The above-mentioned cylindrical part (15) of the hood is provided with a pair of slits (20), each of which receives one of the said pins (19) of the spray head. The pins protrude out of the slits (20) and contact a lever arm (25), which is explained in detail later.

On the hood is mounted a holder for ornamental articles (23). The holder comprises an annular body (24) with a pair of brackets (26) secured on one end of the annular part. The annular part is placed on the hood (13) surrounding the cylindrical section thereof (15) secured thereto. The annular part has a plurality of small holes to receive articles to be supported.

Each bracket (26) is provided with a pivot hole (27) and is resilient and bendable to receive pivots of a lever arm described below. The lever arm (25) has a pair of pivots to be inserted in said pivot holes (27) of the bracket at one end thereof, is provided with an aperture (28) in the middle thereof, which receives the upper part of the cylindrical part (15) of the hood (13), and the rim of the aperture rides upon the pins (19) protruding from the spray head. The other end extends but bends in a stepped form or obliquely upward so that the end projects over the rim of the container therefor to be used.

This sprayer can be used in combination with any vessel in which it can stably be accommodated,—a coffee cup, a wide-mouth bottle, a small flower basket, and the like.

Figure 2:
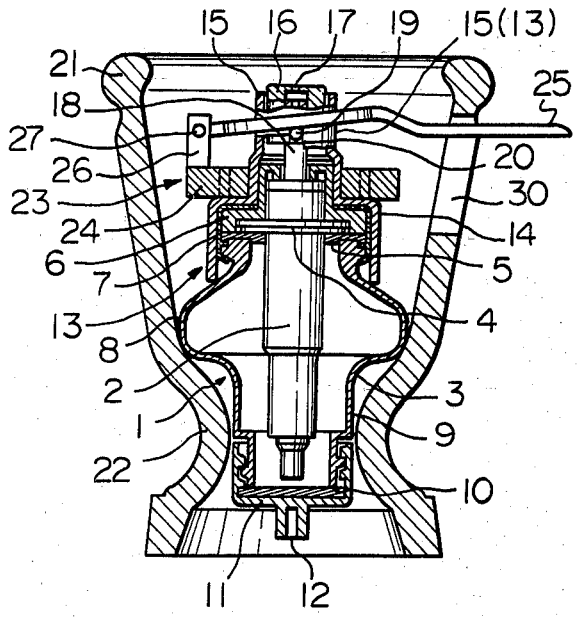
FIG. 2 is an elevational cross-sectional (partly cutout non-cross-sectional) view of a preferred embodiment of the combination spraying apparatus of this invention.

FIG. 2 shows a preferred embodiment of the spraying apparatus of this invention. In FIG. 2, a hand operated sprayer (1) comprises a spray valve or pump (2) and a perfume container (bottle) (3). The former has a flange (4), and the spray valve (2) is secured to the mouth of the perfume container (bottle) (3) by means of said flange (4), a gasket (5), a valve cap (6) and ferrule (7). That is, the gasket is placed on the top of the mouth of the perfume container, then the spray valve (2) is inserted so that its flange is laid on the gasket and then the cap is placed thereon and a ferrule (7) is placed so as to cover all these and is swaged at the underside of the mouth bead of the spray container (bottle). However, this is just one embodiment and other securing measures can be resorted to.

The bottle (3) is expanded below the neck to form a large diameter part (8) and the lower part (9) forms a cylinder. The bottom has an opening, which is provided with a lid (11) which can be secured to the bottle by means of the screw with a gasket (10) sandwiched between the lid and the opening of the bottle. The lid may be provided with a groove (12) which fits the thickness of a coin so that the user can insert the edge of a coin therein and turn the lid to open it.

The spray valve (pump) is the known one that draws up a liquid by the principle of pump and mechanically atomizes the liquid. Employment of the so-called pressure-build-up type sprayer (non-throttling pump) such as disclosed in September 1975 issue of "Aerosol Age" (p. 36) is preferred, although not limited thereto.

The top of the hand operated sprayer (1) comprises a hood (13), the lower part of which forms a skirt (14) which is secured to the ferrule (7) over the cap (6) covering them. The upper part of the hood forms a cylinder extending upward (15). The cylindrical part (15) receives an outlet stem (18), which is an operating member of the spray valve (2). A spray head (16), which is provided with a spray nozzle (mechanical break-up nozzle) (17) at the upper end thereof is secured to the outlet stem (18). A pair of pins (19) are provided on the lower part of the spray head one on each side. The above-mentioned cylindrical part (15) of the hood is provided with a pair of slits (20), each of which receive one of said pins (19) of the spray head. The pins protrude out of the slits (20) and contact a lever arm (25), which is explained in detail later.

The container (21) accommodating the sprayer (1) is a vase-like or flower-pod-like cylindrical body with an open bottom preferably made of a rather heavy material such as porcelain. The lower part thereof (22) is a little constricted so as to fit the lower cylindrical part (9) of the bottle (3) and stably supports the expanded larger diameter part (8) of the bottle by the inside wall of the enlarging part thereof above said constricted part. The opening or the upper rim of the container is preferably at a little higher level than the above-mentioned spray nozzle (17).

On the hood (13) is mounted a holder for ornamental articles (23). The holder comprises an annular body (24) with a pair of brackets (26) secured to one end of the annular part. The annular part is placed on the hood (13), surrounding the cylindrical part thereof (15) secured thereto. The annular part has a plurality of small holes to receive articles to be held.

Each bracket (26) is provided with a pivot hole (27) and the brackets are resilient and bendable to receive pivots of a lever arm described below. The lever arm (25) has a pair of pivots to be inserted in said pivot holes (27) of the brackets at one end thereof, is provided with an aperture (28) in the middle thereof as shown in FIG. 2, which receives the upper part of the cylindrical part (15) of the hood (13), and the rim of the aperture rides upon the pins (19) protruding from the spray head. The other end extends approximately in the horizontal direction through an aperture (30) provided in the wall of the container (21) and projects further as shown in FIG. 2.

The shape of the perfume container (bottle) (3) of the hand operated sprayer and the container (21) is not limited to that shown in the drawings, but any shape will do if it is designed so that the bottle (3) is stably accommodated in the container (21) and the bottom of the bottle with screwed lid (11) is placed in the opening of the container but the lid does not project therefrom. The shape of the container is not limited to "vase-like" or "flower-pot-like", and may be chosen according to the ornamental article employed.

In the above described embodiment, the lever arm (25) horizontally extends through the aperture (30). But the aperture is dispensable. That is, the lever arm can be designed so that it extends obliquely upward above the upper edge of the container, or it remains inside of the container at almost the same level as the upper edge of the container, whereby the end of the lever arm should be operable by means of a finger.

The annular part (24) of the holder for ornamental articles (23) is not limited to the shape as described above, either. For instance, it may be an annular body with an annular groove, which is filled with an annular body made of a material such as foamed polystyrene into which pointed stem-like articles can be stuck. Many variations are possible according to the type of ornamental article to be employed. It is all right if it only can support the employed ornamental articles.

Figure 3:
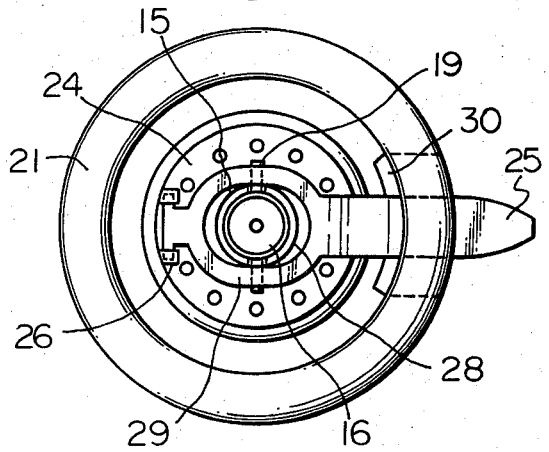
FIG. 3 is a plan view of the preferred embodiment of this invention shown in FIG. 2 in cross section.

In both embodiments of FIG. 1 and FIGS. 2–3, in order to actuate the sprayer, the user simply presses down the end of the lever arm (25). Then the arm is pivoted downward supported by the pivot holes (27) and this presses down the pins (19) of the spray head (16) which contact the perimeter rim (29) of the aperture of the lever arm. Then the spray head, and thus the outlet stem (18) is pressed down and the sprayer is actuated to spray the content of the sprayer (perfume), which is sprinkled upon the ornamental article. The article will emit the fragrance of the perfume. Spraying will be effected occasionally. The user can enjoy the fragrance for a long period of time economically by refilling the perfume.

If the so-called pressure build-up type spray valve (non-throttling pump) is employed, the content of the sprayer remains in the spray valve (pump) all the time and therefore the content is promptly sprayed at the next actuation by operation of the lever arm (25).

Refilling of the perfume container is easily effected by removing the screwed lid (11) at the bottom. The lid can be easily removed by turning it with the aid of a coin inserted in the groove (12) thereof.

The apparatus of this invention is remarkably advantageous in comparison with the known ordinary sprayer with a lid in combination with valve cap, which is placed on the upper opening of the bottle. That is, in the sprayers of that type, the valve cap (6) in FIG. 1 constitutes a screwed lid, which is secured to the mouth of the bottle, and that the ornamental article supporter (24) is mounted tightly thereon. Therefore, in order to remove such a valve cap, at least the lever arm (25) extending through the aperture (30) must be removed. And the holder may have to be removed, too. If the valve cap is removed with said holder (24) mounted thereon, the position of the bracket might be displaced from the original position. It is more or less troublesome to adjust the position of the bracket every time the lid is put on. According to the above described embodiment of this invention, the users are freed from such trouble.

INDUSTRIAL APPLICABILITY

As being apparent from the above detailed description, this invention provides a commercially successful ornamental spraying apparatus comprising a hand-operated sprayer containing an aromatic material, a container therefore which is like a vase or a flower pot, for instance, and a holder for ornamental articles such as artificial flowers and a sprayer therefore, whereby the user can enjoy fragrance emitted from the ornamental article (artificial flowers, for instance) for a long period of time by occasionally supplying them with the aromatic material. Although the invention has been explained with respect to a few specific embodiments, varied modifications are possible within the technical scope of this invention.

I claim:

1. A manually operable spray dispenser comprising a reservoir chamber, a spray dispensing nozzle extending upwardly out of the reservoir chamber, ornament article holding means mounted at the upper end of said chamber, means for ejecting spray through said nozzle from the chamber, a projecting lever pivotally secured to the ornament article holding means for triggering said spray ejecting means and a sealable opening in the reservoir chamber for recharging said chamber.

2. A spray dispenser as claimed in claim 1, wherein the spray valve has a flange, and wherein a valve cap and said flange are air-tightly secured to a mouth of the reservoir chamber by means of a ferrule.

3. A spray dispenser as claimed in claim 2, wherein a hood is mounted on the valve cap and the ferrule and consists of a skirt part covering the ferrule and an upwardly extended cylindrical part, the latter receiving an extended outlet stem of the spray valve and a spray head secured thereto, and having a pair of slits which receive a pair of pins provided in the spray head, wherein the lever is pivotably supported at one part of said hood and rides on said pins so that the outlet stem is pressed down to actuate the valve when the other end of the lever is pressed down, and wherein said spray head is provided with a mechanical break-up nozzle.

4. A spray dispenser as claimed in claim 3, wherein the holder means for the ornamental article is an annular body tightly mounted on the cylindrical part of the hood, said annular body being provided with a plurality of small holes to receive ornamental articles to be supported and a supporting means for the operating lever.

5. A spray dispenser as claimed in claim 3, wherein the holder means for the ornamental article is an annular body tightly mounted on the cylindrical part of the hood, said annular body being provided with an annular groove and a supporting means for the operating lever arm, said annular groove being filled with an annular body made of a material, into which pointed things can easily be stuck.

6. A spray dispenser as claimed in claim 1, wherein a screwed lid is dimensioned to fit in the sealable opening and has a groove to fit the thickness of a coin or the like.

7. A spray dispenser as claimed in claim 1, wherein the dispenser is adopted to seat within a container, and wherein the operating lever is shaped to clear a rim of said container.

8. A spray dispenser as claimed in claim 7, wherein the lever arm extends obliquely upward over the rim of the container.

9. A spray dispenser as claimed in claim 3, wherein the lever arm has an aperture which receives the cylindrical part of the hood.

10. An ornamental spraying apparatus comprising in combination a sprayer having an upwardly directed nozzle and a reservoir chamber having an opening at the bottom through which refilling of the material to be sprayed is effected; an ornamental article holder means mounted at the top of said sprayer, to a part of which a lever means to actuate said sprayer is pivotably secured, and a container with an open bottom for accomodating said sprayer and reservoir chamber.

11. The ornamental spraying apparatus as claimed in claim 10, wherein the sprayer is of the pressure build-up type.

12. The ornamental spraying apparatus as claimed in claim 10, wherein the sprayer incorporates a valve having a flange and a valve cap air-tightly secured to the mouth of the reservoir chamber by means of a ferrule.

13. The ornamental spraying apparatus as claimed in claim 12, wherein the top of the sprayer has a hood, which is mounted on the valve cap and the ferrule and consists of a skirt part covering the ferrule and an upwardly extended cylindrical part, the latter receiving an extended outlet stem of the spray valve and a spray head secured thereto, and having a pair of slits which receive a pair of pins provided in the spray head; a lever arm is pivotably supported at one part of said hood and rides on said pins so that the outlet stem is pressed down to actuate the valve when the other end of the lever arm is pressed down; and said spray head is provided with a mechanical break-up nozzle.

14. The ornamental spraying apparatus as claimed in claim 10, wherein the container for the sprayer is of the vase-like or flower-pod-like shape with an aperture through which the operating lever arm projects.

15. The ornamental spraying apparatus as claimed in claim 10, wherein the holder for the ornamental articles is an annular body to be tightly mounted on the cylindrical part of the hood of the sprayer and is provided with a plurality of small holes to receive ornamental articles to be supported and a supporting means for the operating lever arm.

16. The ornamental spraying apparatus as claimed in claim 10, wherein the holder for the ornamental article is an annular body to be tightly mounted on the cylindrical part of the hood of the sprayer, said annular body being provided with an annular groove and a supporting means for the operating lever arm, said annular groove being filled with an annular body made of a material, into which pointed things can easily be stuck.

17. The ornamental sprayer apparatus as claimed in claim 10, wherein a screwed lid is dimensioned to fit in the bottom opening of the reservoir chamber and has a groove to receive the thickness of a coin or the like.

18. The ornamental sprayer apparatus as claimed in claim 10, wherein the ornamental article holder means is adapted to accomodate artificial flowers.

19. The ornamental sprayer apparatus as claimed in claim 10, wherein the lever has an aperture to receive the top of the sprayer.

* * * * *